US009145901B2

(12) United States Patent
Li et al.

(10) Patent No.: US 9,145,901 B2
(45) Date of Patent: Sep. 29, 2015

(54) HEATING PUMP

(75) Inventors: Yue Li, Hong Kong (CN); Lisheng Liu, Shenzhen (CN); Hongjian Zhang, Shenzhen (CN); Zongqian Qi, Shenzhen (CN); Awade Badafem, Shenzhen (CN); Min Li, Shenzhen (CN)

(73) Assignee: Johnson Electric S.A., Murten (CH)

( * ) Notice: Subject to any disclaimer, the term of this patent is extended or adjusted under 35 U.S.C. 154(b) by 763 days.

(21) Appl. No.: 13/446,807

(22) Filed: Apr. 13, 2012

(65) Prior Publication Data

US 2012/0263581 A1 Oct. 18, 2012

(30) Foreign Application Priority Data

Apr. 15, 2011 (CN) ..... 2011 1 0095904
May 23, 2011 (CN) ..... 2011 1 0157895

(51) Int. Cl.

| | |
|---|---|
| ***F04D 13/06*** | (2006.01) |
| ***F04D 29/58*** | (2006.01) |
| ***D06F 39/08*** | (2006.01) |
| *A47L 15/42* | (2006.01) |
| *D06F 39/04* | (2006.01) |

(52) U.S. Cl.

CPC ..... *F04D 29/588* (2013.01); *D06F 39/085* (2013.01); *A47L 15/4225* (2013.01); *A47L 15/4285* (2013.01); *A47L 2401/12* (2013.01); *D06F 39/04* (2013.01)

(58) Field of Classification Search

None

See application file for complete search history.

(56) References Cited

U.S. PATENT DOCUMENTS

| | | | | |
|---|---|---|---|---|
| 3,069,735 | A * | 12/1962 | Toulmin, Jr. | 422/307 |
| 4,866,250 | A * | 9/1989 | Pasbrig | 392/479 |
| 5,701,388 | A * | 12/1997 | Steinhardt et al. | 392/471 |
| 7,287,536 | B2 * | 10/2007 | Steck et al. | 134/107 |
| 7,965,928 | B2 | 6/2011 | Eichholz et al. | |
| 2010/0126534 | A1 | 5/2010 | Busing et al. | |

FOREIGN PATENT DOCUMENTS

| | | | |
|---|---|---|---|
| EP | 1247993 | B1 | 3/2009 |
| EP | 2221485 | A2 | 8/2010 |
| WO | WO-2006/027331 | A1 | 3/2006 |

* cited by examiner

*Primary Examiner* — Nathaniel Wiehe
*Assistant Examiner* — Brian O Peters
(74) *Attorney, Agent, or Firm* — Muncy, Geissler, Olds & Lowe, P.C.

(57) ABSTRACT

A heating pump includes an electric motor, a pump housing fixed to the motor, an impeller driven by the motor, and a ring heater with an inner hole for heating fluid in the pump housing. The pump housing has a pump chamber and a pump inlet and a pump outlet which are in fluid communication with the pump chamber. The impeller is received in the pump housing and having an impeller inlet and a plurality of impeller outlets. The ring heater is disposed inside the pump chamber and between the pump inlet and the impeller. The impeller inlet is in fluid communication with the pump inlet via the inner hole.

20 Claims, 7 Drawing Sheets

HEATING PUMP

CROSS REFERENCE TO RELATED APPLICATIONS

This non-provisional patent application claims priorities under 35 U.S.C. §119(a) from Patent Application No. 201110095904.3 filed in The People's Republic of China on Apr. 15, 2011 and Patent Application No. 201110157895.6 filed in The People's Republic of China on May 23, 2011.

FIELD OF THE INVENTION

This invention relates to a pump and in particular, to a pump having a heater.

BACKGROUND OF THE INVENTION

US2010/0126534 discloses a pump including a housing, an impeller disposed in the pump housing, an electric motor for driving the impeller and a heating device for heating washing liquid in the pump housing. The housing of the pump includes a housing base and a housing cover. The heating device is mounted between the housing base and the housing cover and forms a ring-shaped side wall of the housing. The washing liquid is heated only by the inner surface of the heating device after it flows out of the impeller.

SUMMARY OF THE INVENTION

In one aspect thereof, the present invention provides a heating pump comprising an electric motor, a pump housing fixed to the motor, an impeller driven by the motor, and a ring heater with an inner hole for heating fluid in the pump housing, the pump housing having a pump chamber, and a pump inlet and a pump outlet which are in fluid communication with the pump chamber, the impeller being received in the pump housing and having an impeller inlet and a plurality of impeller outlets. The ring heater is disposed inside the pump chamber and between the pump inlet and the impeller. The impeller inlet is in fluid communication with the pump inlet via the inner hole.

Preferably, the impeller partly extends into the inner hole of the ring heater.

Preferably, the ring heater is mounted to the pump housing via a thermal insulator.

Preferably, the ring heater is an annular ring heater, an inner diameter of the annular ring heater being less than an outer diameter of the impeller, and an outer diameter of the annular ring heater being greater than the outer diameter of the impeller.

Preferably, the ring heater has a first guiding structure for directing the fluid to smoothly pass through a space between the ring heater and the impeller.

Preferably, the ring heater has a second guiding structure for directing the fluid to the pump outlet.

Preferably, the heating pump further comprises a heat sensor having signal wires, the heat sensor being mounted onto a surface of the ring heater, and the signal wires passing through a hole on the pump housing.

Preferably, the ring heater includes a heater body made of thermally conductive material and at least one electrical heating wire embedded in the heater body.

Preferably, the ring heater further includes a protective sleeve covering the heater body to prevent the fluid from making direct contact with the heater body.

Preferably, the ring heater has a heating projection extending from the heater body.

Preferably, the ring heater has two electrical heating wires connected in parallel.

Optionally, the impeller outlets overlap with the pump outlet in an axial direction of the impeller.

Optionally, the inner hole of the ring heater defines a first fluid path, and an outer surface of the ring heater and an inner surface of the pump housing define a second fluid path, the impeller outlets being in communication with the pump outlet via the second fluid path.

Preferably, the heating pump further comprises a further guiding structure surrounding the impeller to direct the fluid to the second fluid path from the impeller outlets.

Optionally, the impeller outlets are spaced from the pump outlet an axial direction of the impeller.

In the embodiments of the present invention, after the fluid is heated by the inner surface of the ring heater before flowing into the impeller, it can be further heated by the outer surface of the ring heater.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
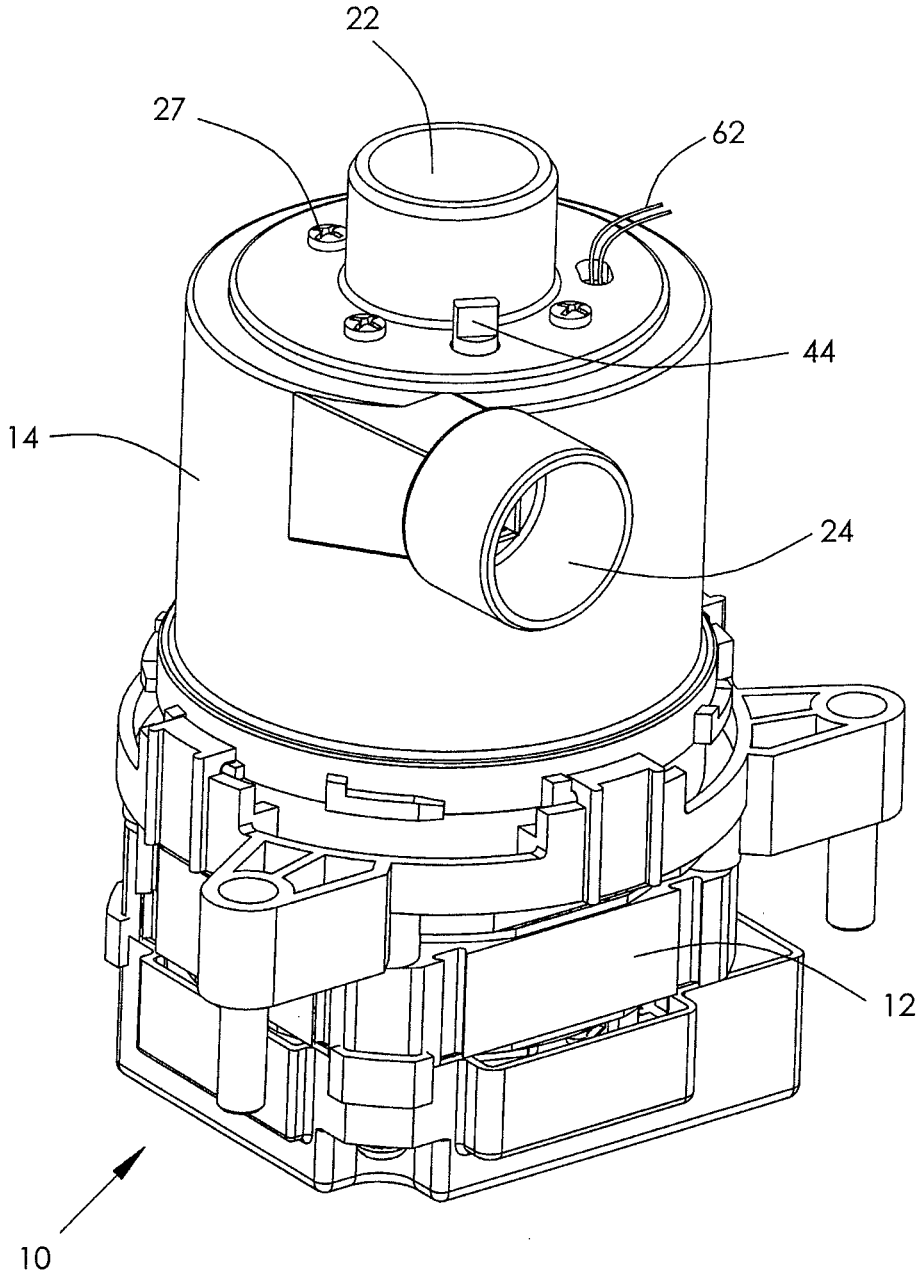
FIG. 1 is a view of a heating pump in accordance with a preferred embodiment of the present invention.
Figure 2:
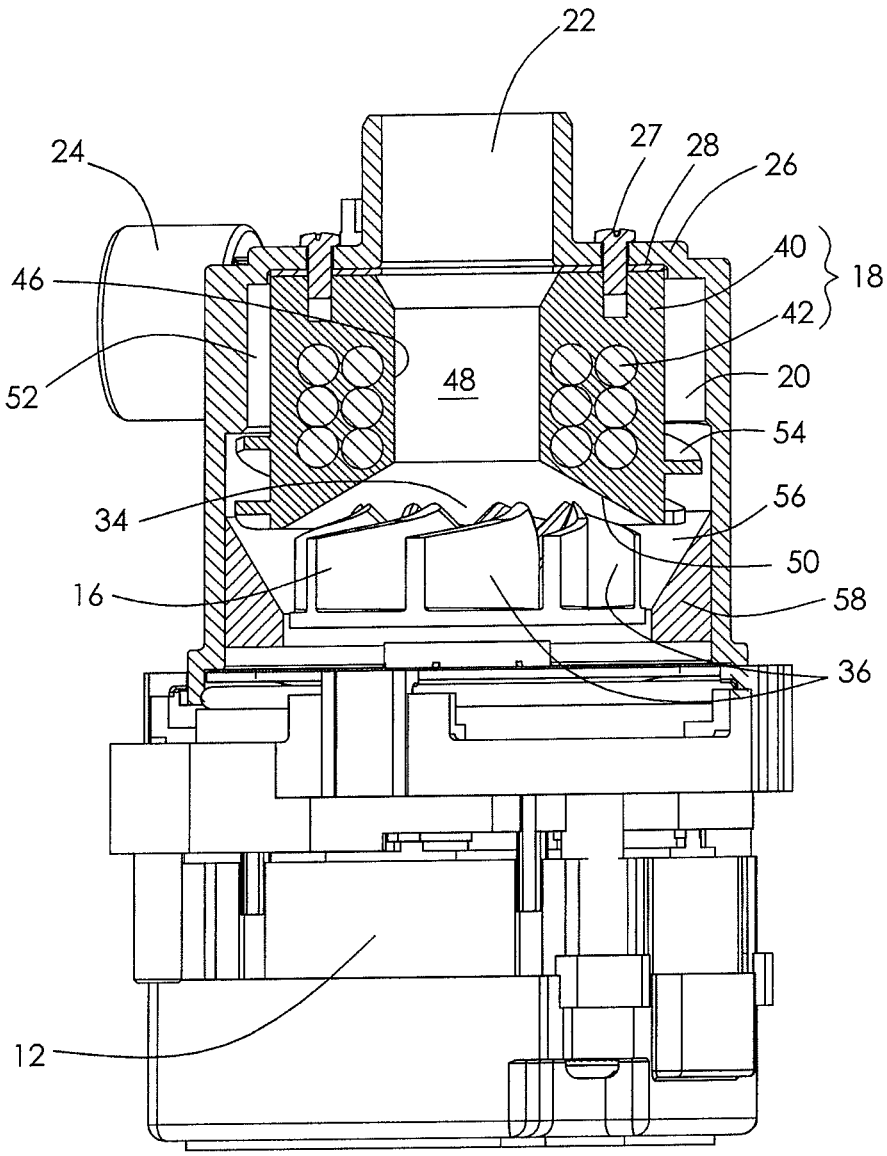
FIG. 2 is a sectional view of the heating pump of FIG. 1.
Figure 3:
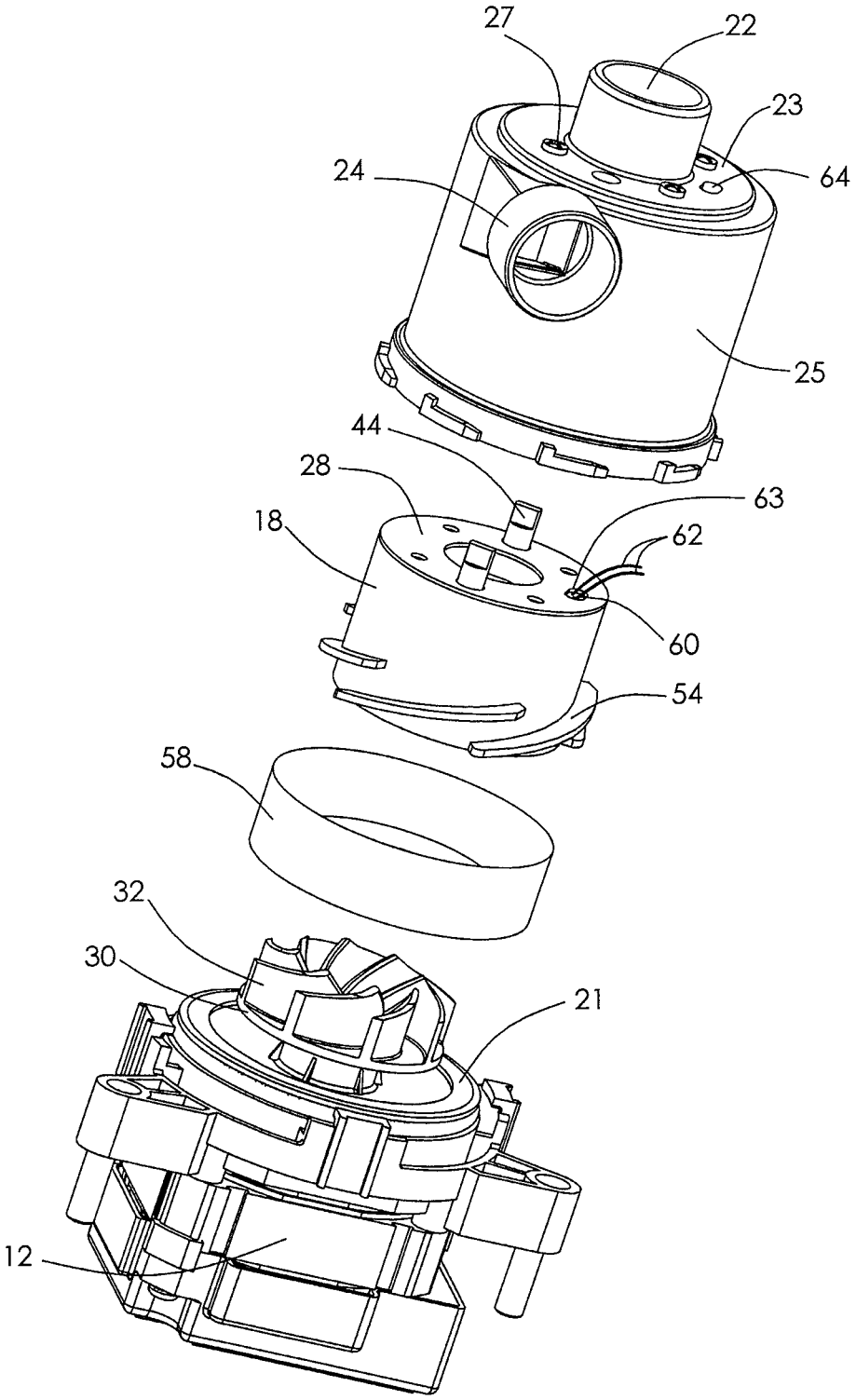
FIG. 3 is an exploded view of the heating pump of FIG. 1.
Figure 4:
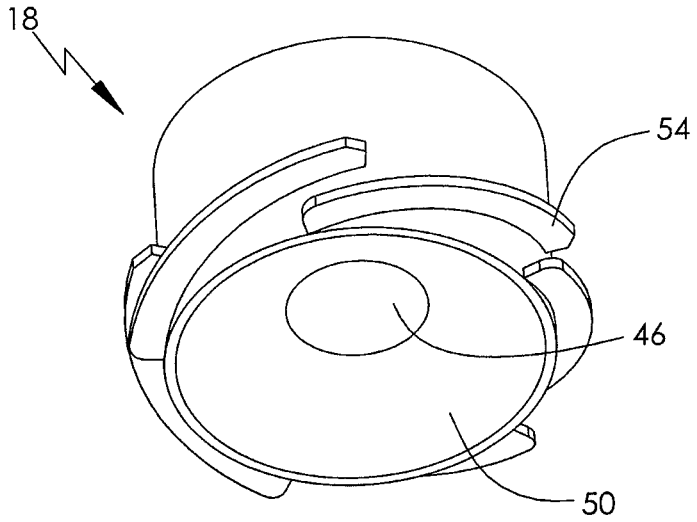
FIG. 4 is a view of a heater being a part of the heating pump of FIG. 1.

With reference to the preferred embodiment of the present invention shown in FIGS. 1 to 4, a heating pump 16 includes an electric motor 12, a pump housing 14 fixed to the motor 12, an impeller 16 driven by the motor 12, and a ring heater 18 for heating the fluid in the pump housing 14. The motor may include a mounting frame.

The pump housing 14 has a pump chamber 20 defined by a base wall 21, a cover wall 23 and a side wall 25, and a pump inlet 22 and a pump out 24 which are in fluid communication with the pump chamber 20. The pump inlet 22 axially outwardly extends from the cover wall 23 and the pump outlet 24 outwardly extends from the side wall 25.

The impeller 16 is arranged inside the pump chamber 20 and includes a base plate 30 and a plurality of blades 32 extending from one surface of the base plate 30 facing the pump inlet 22. Inner ends of the plurality of blades 32 define an impeller inlet 34 adjacent the pump inlet 22. Outer ends of every two adjacent blades 32 define an impeller outlet 36.

The ring heater 18 is arranged inside the pump chamber 20 and located between the pump inlet 22 and the impeller 16. The ring heater 18 is mounted to a mounting surface 26 of the pump housing 14 via screws 27. A thermal insulator 28 is disposed between the ring heater 18 and the mounting surface 26 to reduce the heat generated by the ring heater 18 from transferring to the pump housing 14. Preferably the thermal insulator 28 is made of heat resistant plastic. The ring heater 18 includes a heater body 40 made of thermally conductive material such as cast aluminum and a heating wire 42 embedded in the heater body 40. The heater body 40 is a hollow cylinder with two open ends. The inner diameter of the heater body 40 is less than the outer diameter of the impeller 16 and the inner diameter of the pump inlet 22. The outer diameter of the heater body 40 is greater than the outer diameter of the impeller 16. Electrical terminals 44 of the heating wire 42 pass through holes on the pump housing 14 to be connected to an external power supply. The inner hole 46 of the heater body 40 defines a first fluid path 48. The impeller inlet 34 is in fluid communication with the pump inlet 22 via the inner hole 46. By this configuration, the fluid can be heated before entering into the impeller 16. The impeller 16 partly extends into the inner hole 46 and the diameter of the inner hole 46 gradually increases towards the impeller 16 at one end near the impeller 16 to form a first fluid structure 50 conforming with the impeller 16 to direct the fluid to smoothly pass through the space between the ring heater 18 and the impeller 16 to improve the hydraulic efficiency of the pump.

In this embodiment, the pump outlet 34 outwardly extends from the top portion of the side wall 25 of the pump housing 14 and is spaced from the impeller outlets 36 in the axial direction of the impeller. A second fluid path 52 is defined between the outer surface of the ring heater 18 and the inner surface of the side wall 25. A plurality of spiral fins 54 are circumferentially spaced on the outer surface of the heater 18. The spiral fins 54 form a second guiding structure to direct the fluid in the second fluid path 52 to the pump outlet 34. The fins 54 increase the heating surface area of the ring heater 18 as well as improving the heating efficiency. A guide ring 58 is disposed inside the bottom portion of the side wall 25 and surrounds the impeller 16. A third fluid path 56 is defined between the guide ring 58 and the impeller outlets 36. The inner diameter of the guide ring 58 gradually increases towards the ring heater 18 to form a third guiding structure to direct the fluid flowing out of the impeller outlets 36 to the second fluid path 52 via the third fluid path 56. The guide ring 58 is a member separate from and mounted to the pump housing 14. Alternatively, the guide ring 58 and the pump housing 14 may be a single piece monolithic structure.

The heating pump 10 further includes a heat sensor 60 for sensing the temperature of the ring heater 18. The heat sensor 60 is preferably a thermally sensitive (temperature dependent) resistor with two signal wires 62. The heat sensor 60 is mounted onto a surface of the ring heater 18 near the mounting surface 26 and received in a hole 63 on the thermal insulator 28. The signal wires 62 of the heat sensor 60 passes through a hole 64 on the pump housing 14 to be connected to an external control circuit.

In this embodiment, the fluid is heated by the inner surface of the ring heater 18 before flowing into the impeller 16 and is further heated by the outer surface of the ring heater 18 after flowing out of the impeller before leaving the pump chamber.

Figure 5:
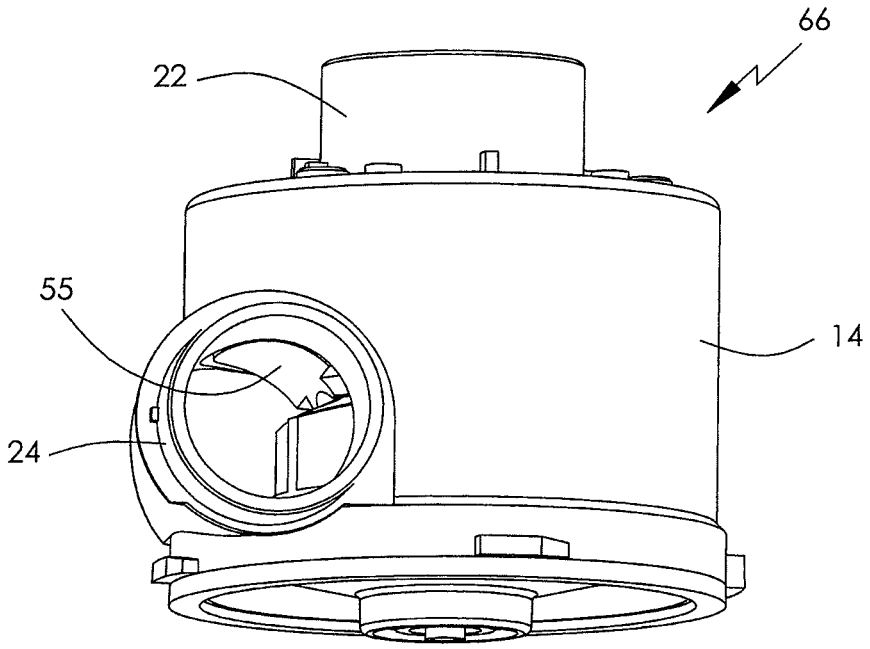
FIG. 5 is a view of a heating pump in accordance with another embodiment of the present invention, with an electric motor removed.
Figure 6:
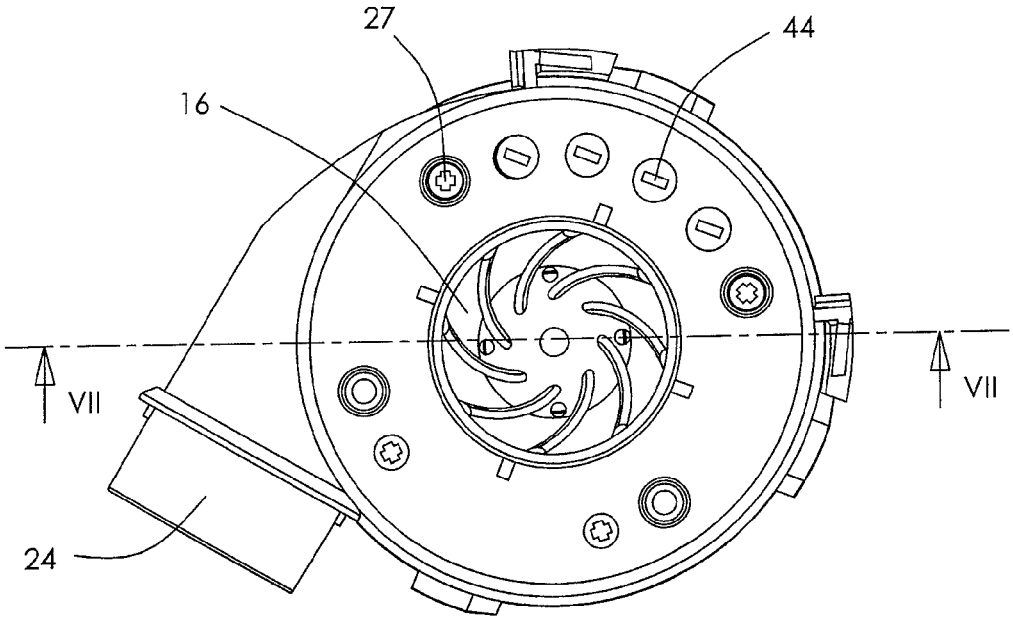
FIG. 6 is a top view of the heating pump of FIG. 5.
Figure 7:
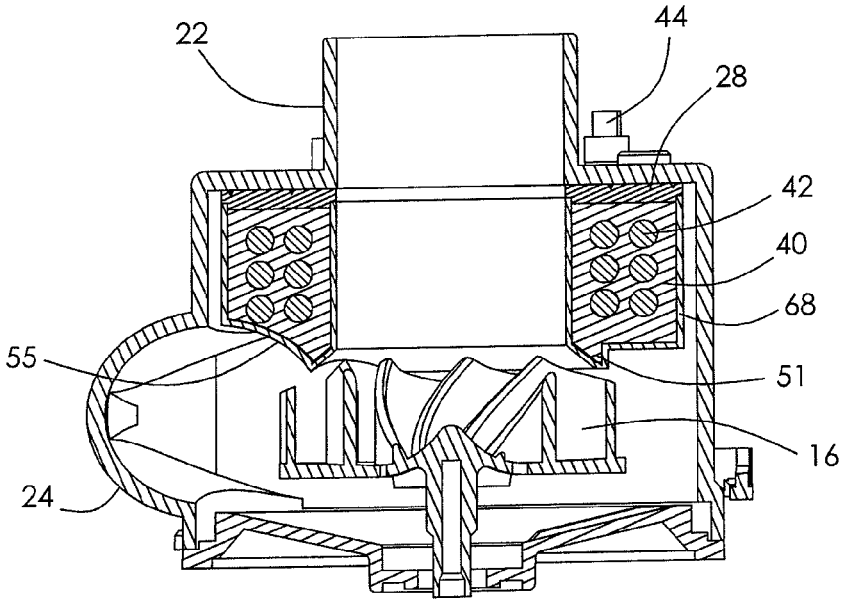
FIG. 7 is a sectional view along line VII-VII of FIG. 6.

FIGS. 5 to 7 show a heating pump 66 in accordance with another embodiment of the present invention. In this embodiment, the pump outlet 24 outwardly extends from the bottom portion of the side wall 25 of the pump housing 14. The impeller outlets 36 are disposed adjacent the pump outlet 24 such that they overlap in the axial direction so that the fluid flowing out of the impeller 16 can directly flow into the pump outlet 24 to reduce hydraulic loss. The diameter of the inner hole 46 is substantially equal to the inner diameter of the pump inlet 55. Alternatively, the diameter of the inner hole 46 may be greater than the inner diameter of the pump inlet 55. An annular flange 51 axially extends towards the impeller 16 from the heater body 40. The inner diameter of the annular flange 51 gradually increases towards the impeller 16 to form a first guiding structure conforming with the impeller 16 so as to direct the fluid to smoothly pass through the space between the ring heater 18 and the impeller 16. A curved cut out 55 matching with the geometry of the pump outlet 24 is formed in the heater body 40 at a position near the pump outlet 34 to form a second guiding structure so as to direct the fluid to smoothly flow into the pump outlet 34 to improve the hydraulic efficiency.

Two heating wires 42 connected in parallel are embedded in the heater body 40. Four electrical terminals 44 of the two heating wires 42 are shown in FIG. 6. By this configuration, the diameter of the heating wires 42 can be reduced and the heating wires can be evenly embedded in the heater body 40.

When the heating pump is applied to a kitchen appliance, the ring heater preferably has a protective sleeve 68 covering the heater body 40 to prevent the fluid from making direct contact with the heater body 40. The protective sleeve 68 conforms with the heater body 40 and is made of thermally conductive material conforming to certain food safety requirements, such as stainless steel.

Figure 8:
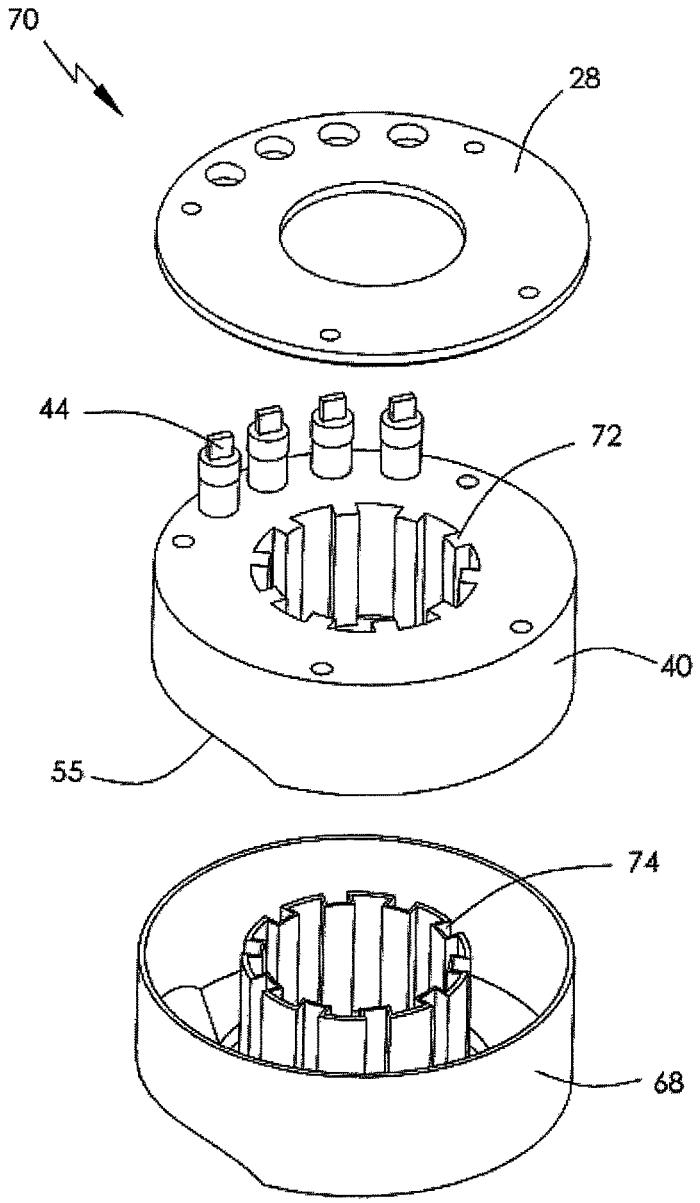
FIG. 8 is an exploded view of an alternative heater for the heating pump of FIG. 5.

FIG. 8 is a view of an alternative ring heater 70 for the heating pump 66. A plurality of axially extending heating projections 72 inwardly extend from the heater body 40 and a plurality of corresponding grooves 74 are formed on the protective sleeve 68 to receive the heating projections 72. The heating projections 72 increase the heating surface area of the ring heater 18 so as to improve the heating efficiency.

Figure 9:
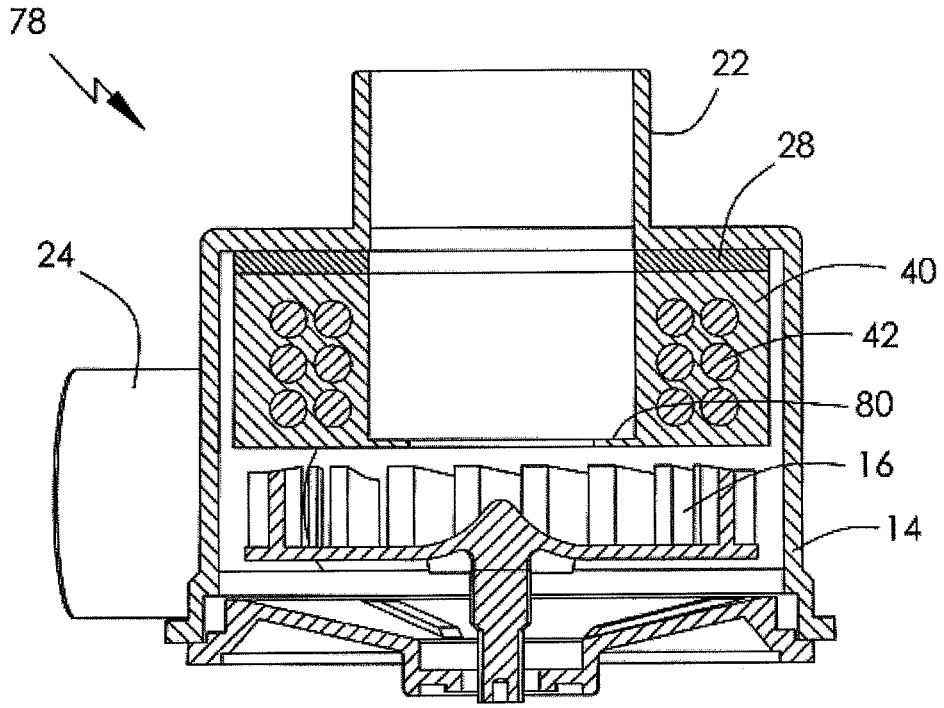
FIG. 9 is a view of a heating pump in accordance with a third embodiment of the present invention, with an electric motor removed.

Referring to FIG. 9, in a heating pump 78 in accordance with a third embodiment of the present invention, an annular step 80 inwardly extends from the heater body 40 at one end near the impeller 16 to form a heating projection so as to increase the heating surface area of the ring heater 18.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A heating pump comprising: an electric motor, a pump housing fixed to the motor, an impeller driven by the motor, and a ring heater with an inner hole for heating fluid in the pump housing, the pump housing having a pump chamber, and a pump inlet and a pump outlet which are in fluid communication with the pump chamber, the impeller being received inside the pump housing and having an impeller inlet and a plurality of impeller outlets, wherein the ring heater is disposed inside the pump chamber and between the pump inlet and the impeller, and the impeller inlet is in fluid communication with the pump inlet via the inner hole;

wherein the fluid is heated by the ring heater before entering into the impeller.

2. The heating pump of claim 1, wherein the impeller partly extends into the inner hole of the ring heater.

3. The heating pump of claim 1, wherein a thermal insulator is disposed between the ring heater and the pump housing.

4. The heating pump of claim 1, wherein the ring heater is an annular ring heater, an inner diameter of the annular ring heater being less than an outer diameter of the impeller, and an outer diameter of the annular ring heater being greater than the outer diameter of the impeller.

5. The heating pump of claim 1, wherein a diameter of the inner hole of the ring heater gradually increases towards the impeller at one end near the impeller to form a first guiding structure to direct the fluid to smoothly pass through a space between the ring heater and the impeller.

6. The heating pump of claim 1, wherein a plurality of spiral fins are circumferentially spaced on the outer surface of the ring heater, the spiral fins form a second guiding structure to direct the fluid to the pump outlet.

7. The heating pump of claim 1, wherein the heating pump further comprises a heat sensor having signal wires, the heat sensor being mounted onto a surface of the ring heater, and the signal wires passing through a hole on the pump housing.

8. The heating pump of claim 1, wherein the ring heater includes a heater body made of thermally conductive material and at least one electrical heating wire embedded in the heater body.

9. The heating pump of claim 8, wherein the ring heater further includes a protective sleeve covering the heater body to prevent the fluid from making direct contact with the heater body.

10. The heating pump of claim 9, wherein the ring heater has a axial heating projection inwardly extending from the heater body, a corresponding groove is formed on the projective sleeve to receive the heating projection.

11. The heating pump of claim 8, wherein the ring heater has two electrical heating wires connected in parallel.

12. The heating pump of claim 8, wherein an annular step inwardly extends from the heater body at one end near the impeller to form a heating projection.

13. The heating pump of claim 1, wherein the impeller outlets overlap the pump outlet in an axial direction of the impeller.

14. The heating pump of claim 1, wherein the inner hole of the ring heater defines a first fluid path, and an outer surface of the ring heater and an inner surface of the pump housing define a second fluid path, the impeller outlets being in communication with the pump outlet via the second fluid path.

15. The heating pump of claim 14, wherein the heating pump further comprises a guiding structure surrounding the impeller to direct the fluid to the second fluid path from the impeller outlets.

16. The heating pump of claim 15, wherein the guiding structure is a guiding ring.

17. The heating pump of claim 16, wherein an inner diameter of the guide ring gradually increases towards the ring heater to form a third guiding structure to direct the fluid flowing out of the impeller outlets to the second fluid path via the third fluid path.

18. The heating pump of claim 14, wherein the impeller outlets and the pump outlet are spaced apart in an axial direction of the impeller.

19. A heating pump comprising:

an electric motor;

a pump housing fixed to the motor, the pump housing having a pump chamber, and a pump inlet and a pump outlet which are in fluid communication with the pump chamber;

an impeller driven by the motor, the impeller being disposed inside the pump housing and having an impeller inlet aligned with the pump inlet and a plurality of impeller outlets spaced from the pump outlet in an axial direction of the impeller;

a ring heater having a heater body made of thermally conductive material and at least one electrical heating wire embedded in the heater body, the ring heater having an inner hole for heating fluid in the pump housing and being disposed inside the pump chamber between the pump inlet and the impeller, the impeller inlet being in fluid communication with the pump inlet via the inner hole;

a heat sensor mounted on a surface of the ring heater and having signal wires passing through a hole on the pump housing;

a protective sleeve covering the heater body to prevent the fluid from making direct contact with the heater body; and a thermal insulator disposed between the ring heater and the pump housing, wherein the inner hole of the ring heater defines a first fluid path, and an outer surface of the ring heater and an inner surface of the pump housing define a second fluid path, the impeller outlets being in communication with the pump outlet via the second fluid path, and wherein the ring heater has a first guiding structure for smoothly guiding the fluid through a space between the ring heater and the impeller, a second guiding structure for guiding the fluid to the pump outlet along the second fluid path, and a third guiding structure surrounding the impeller for guiding the fluid to the second fluid path from the impeller outlets;

wherein the fluid is heated by the ring heater before entering into the impeller.

20. The heating pump of claim 16, wherein the ring heater is an annular ring heater, an inner diameter of the annular ring heater being less than an outer diameter of the impeller, and an outer diameter of the annular ring heater being greater than the outer diameter of the impeller.

* * * * *